US012030098B2

(12) United States Patent
Norikura et al.

(10) Patent No.: US 12,030,098 B2
(45) Date of Patent: Jul. 9, 2024

(54) MULTISTAGE ROLLING MILL

(71) Applicant: SENDZIMIR JAPAN, LTD., Tokyo (JP)

(72) Inventors: Takashi Norikura, Tokyo (JP); Tadashi Tamagawa, Tokyo (JP)

(73) Assignee: SENDZIMIR JAPAN, LTD., Tokyo (JP)

( * ) Notice: Subject to any disclaimer, the term of this patent is extended or adjusted under 35 U.S.C. 154(b) by 246 days.

(21) Appl. No.: 17/774,209

(22) PCT Filed: Jan. 21, 2021

(86) PCT No.: PCT/JP2021/001937
§ 371 (c)(1),
(2) Date: May 4, 2022

(87) PCT Pub. No.: WO2021/149747
PCT Pub. Date: Jul. 29, 2021

(65) Prior Publication Data

US 2022/0379358 A1 Dec. 1, 2022

(30) Foreign Application Priority Data

Jan. 22, 2020 (JP) ..... 2020-008018

(51) Int. Cl.
*B21B 13/14* (2006.01)

(52) U.S. Cl.
CPC ..... *B21B 13/147* (2013.01)

(58) Field of Classification Search
CPC ..... B21B 31/00; B21B 31/02; B21B 31/028; B21B 31/07; B21B 31/04; B21B 13/14; B21B 13/147
See application file for complete search history.

(56) References Cited

U.S. PATENT DOCUMENTS 3,076,360 A * 2/1963 Sendzimir ..... B21B 13/147 72/242.4
5,596,899 A * 1/1997 Sendzimir ..... B21B 13/147 72/248

(Continued)

FOREIGN PATENT DOCUMENTS

EP 2 656 934 A1 10/2013
EP 3950161 A1 9/2022

(Continued)

OTHER PUBLICATIONS

International Search Report of PCT/JP2021/001937 dated Feb. 22, 2021.

(Continued)

*Primary Examiner* — Bobby Yeonjin Kim
(74) *Attorney, Agent, or Firm* — MATTINGLY & MALUR, PC

(57) ABSTRACT

A multistage rolling mill includes: four columns 12*a*, 12*b*, 12*c*, and 12*d* linking, in an up-down direction, four corners of each of an upper mill housing 8, a lower mill housing 9, and a base mill housing 10; a press-down section that is provided on an upper side of the four columns 12*a*, 12*b*, 12*c*, and 12*d* in a vertical direction and that is capable of raising and lowering the upper mill housing 8; and a lower mill housing spacer that is provided between the lower mill housing 9 and the base mill housing 10 and that adjusts the position of the lower mill housing 9 in the vertical direction. With this configuration, a compact multistage rolling mill with a smaller installation space than a conventional cluster-type rolling mill is provided.

10 Claims, 10 Drawing Sheets

(56) References Cited

U.S. PATENT DOCUMENTS

| | | | | |
|---|---|---|---|---|
| 5,857,372 | A * | 1/1999 | Sendzimir | B21B 31/02 72/224 |
| 7,234,334 | B1 * | 6/2007 | Pfabe | B21B 29/00 72/224 |
| 7,765,844 | B2 * | 8/2010 | Guo | B21B 31/04 72/10.7 |
| 2012/0318030 | A1 * | 12/2012 | Guo | B21B 13/147 72/224 |

FOREIGN PATENT DOCUMENTS

| | | | |
|---|---|---|---|
| JP | 2013-018034 | A | 1/2013 |
| JP | 5894849 | B2 | 3/2016 |
| WO | 2020-204071 | A1 | 10/2020 |

OTHER PUBLICATIONS

Indian Office Action received in corresponding Indian Application No. 202217041851 dated Jan. 16, 2023.

* cited by examiner

MULTISTAGE ROLLING MILL

TECHNICAL FIELD

The present invention relates to a cluster-type multistage rolling mill.

BACKGROUND ART

Patent Document 1 states that a cluster mill housing capable of being applied to a 20-high or 12-high cluster mill includes four different parts including a floor section having a central lower roll cavity including parts terminating at end members and having respective vertical columns at four corners thereof, a ceiling section having a central upper roll cavity including parts terminating at each end of handles, and substantially the same bridge members having downwardly directed ends laid on the handles of the ceiling section and attached to top parts of the columns.

Patent Document 2 states that, as one of cluster rolling mills, a strip thickness control system and a prestress rod of a cluster rolling mill are used, high rigidity, a large work roll gap for passing therethrough, a rapid opening of the work roll gap, accurate calculation of a rolling force, and left-right inclination are provided, and work rolls over a wider diameter range are used.

Patent Document 3 states that, as one of techniques for causing a housing of a cluster mill to have both an advantage of a mono-block housing of being high in rigidity and an advantage of a two-part housing of easiness of removal of an entangled strip, or the like, a housing assembly is partitioned into upper-side and lower-side mill housings including a roll cavity and a roll cluster therein on a horizontal direction center line or a horizontal direction plane in the vicinity thereof, screws are provided at each of corners of the assembly, both the mill housings are moved symmetrically equivalently and in opposite directions by the screws to thereby adjust the gap between processing rolls of the roll cluster, and both of the mill housings are made to have therebetween a gap determined by the screws, whereby a hydraulic cylinder and a tie rod for applying such a prestress as to unite them together are provided.

PRIOR ART DOCUMENT

Patent Documents

Patent Document 1: U.S. Pat. No. 5,857,372-A
Patent Document 2: U.S. Pat. No. 7,765,844-A
Patent Document 3: U.S. Pat. No. 5,596,899-A

SUMMARY OF THE INVENTION

Problem to be Solved by the Invention

In a conventional multistage rolling mill of a cluster roll disposition, the mill housing has been configured by a single mono-block. Therefore, deformation is little, and a high mill rigidity necessary to realize a high strip thickness accuracy in strip rolling has been secured. However, the mono-block mill housing has had a problem on the operation basis that the open amount of the work rolls is small, due to a problem on a space basis.

On the other hand, as described in Patent Document 1, there has been devised a rolling mill in which the mill housing is partitioned into upper and lower parts to increase the open amount of the work rolls and the deformation amount of the mill housings that has been increased as a result of the partitioning is decreased by applying a prestress load to the partitioned upper and lower mill housings such that a mill rigidity of the rolling mill is kept high.

However, in the technique described in Patent Document 1, there has been a problem that each roll diameter, particularly, the use range of the work rolls cannot be enlarged. For improvement of this problem, the techniques described in Patent Documents 2 and 3 have been devised.

In Patent Document 2, two mill housings of the upper mill housing and the lower mill housing and four columns connecting them, and an upper hydraulic cylinder for applying a prestress load at upper parts of the four columns, and, further, a lower hydraulic cylinder for changing the position of the upper mill housing between the upper and lower mill housings, are provided.

In Patent Document 2, since a prestress load is applied to the upper and lower mill housings by the upper hydraulic cylinder through the four columns, it has been possible to secure a high mill rigidity. In addition, since the position of the upper mill housing is changed by the lower hydraulic cylinder, there has been an advantage that each roll diameter, particularly, the use range of the work rolls is enlarged. Further, since a wedge adjusting block is provided under the lower mill housing, it has been possible to raise and lower the upper and lower mill housing as a whole and to keep the pass line constant.

In addition, in Patent Document 3, two mill housings of the upper mill housing and the lower mill housing and eight columns connecting them, and an upper hydraulic cylinder for applying a prestress load at upper parts of the eight columns, and, further, an upper screw for changing the position of the upper mill housing and a lower screw for changing the position of the lower mill housing between the upper and lower mill housings, have been provided.

In Patent Document 3, since a prestress load is applied to the upper and lower mill housings through the eight columns, it has been possible to secure a high mill rigidity. In addition, since the position of the upper mill housing can be changed by the upper screw, there has been an advantage that each roll diameter, particularly, the use range of the work rolls is enlarged. Further, since the position of the lower mill housing can be changed by the lower screw, it has been possible to keep the pass line constant.

However, in the techniques described in Patent Documents 2 and 3, for allowing the upper and lower mill housings as a whole to be capable of being raised and lowered, to secure accuracy of the raising and lowering, such a rigid and large outer housing as to cover the upper and lower mill housings as a whole or such a large outer frame as to rigidly support the upper and lower mill housings as a whole has been additionally needed as a raising and lowering guide. Therefore, there has been a problem that a wide installation space should be taken. In addition, since a large structure is needed, a rise in the cost of the rolling mill as a whole is caused, thereby causing an economical problem as well.

The present invention provides a compact multistage rolling mill with a smaller installation space than a conventional cluster-type rolling mill.

Means for Solving the Problem

The present invention includes multiple means for solving the above-mentioned problem, there is provided, as one example thereof, a cluster-type multistage rolling mill including: a pair of upper and lower work rolls that roll a metal strip; an intermediate roll group that supports the work rolls; a plurality of partition backing bearing shafts each including a partition backing bearing, a shaft, and a saddle that support the intermediate roll group; an upper mill housing that supports an upper side partition backing bearing shafts in a vertical direction, of the partition backing bearing shafts; a lower mill housing that supports a lower side partition backing bearing shafts in the vertical direction, of the partition backing bearing shafts; a base mill housing disposed on a lower side of the lower mill housing in the vertical direction; four columns that link, in an up-down direction, four corners of each of the upper mill housing, the lower mill housing, and the base mill housing; a press-down section that is provided on an upper side of the four columns in the vertical direction and that is capable of raising and lowering the upper mill housing; and a lower mill housing spacer that is provided between the lower mill housing and the base mill housing and that adjusts a position of the lower mill housing in the vertical direction.

Advantages of the Invention

According to the present invention, a compact multistage rolling mill with a smaller installation space than a conventional cluster-type rolling mill can be realized. The other problems, configurations, and advantages than those mentioned above will be made clear by the following description of the embodiments.

MODES FOR CARRYING OUT THE INVENTION

An embodiment of a multistage rolling mill of the present invention will be described below with reference to the drawings.

First Embodiment

A first embodiment of the multistage rolling mill of the present invention will be described with reference to FIGS. 1 to 8.

Figure 1:
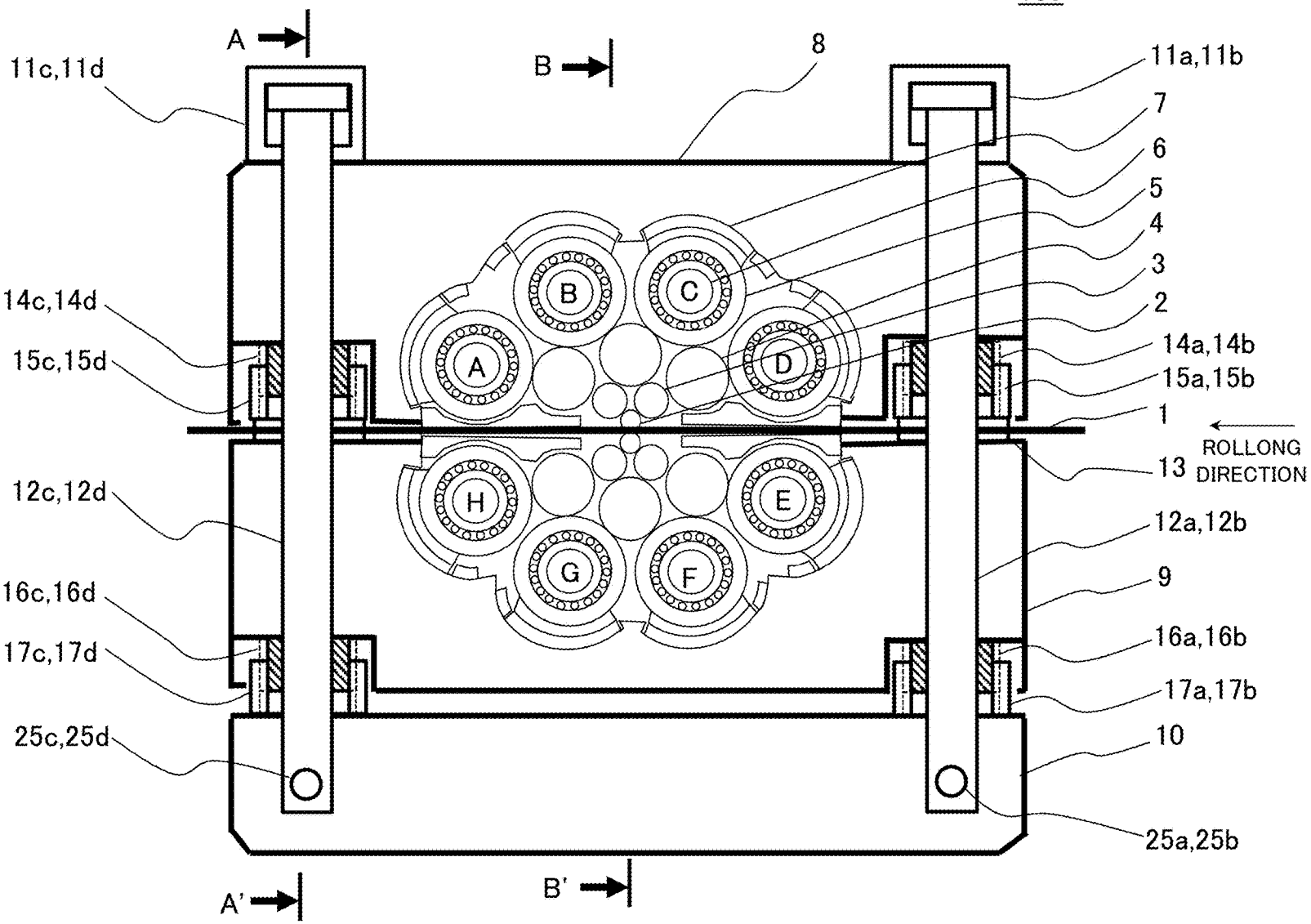
FIG. 1 is a front view of a 20-high rolling mill according to a first embodiment of the present invention.
Figure 2:
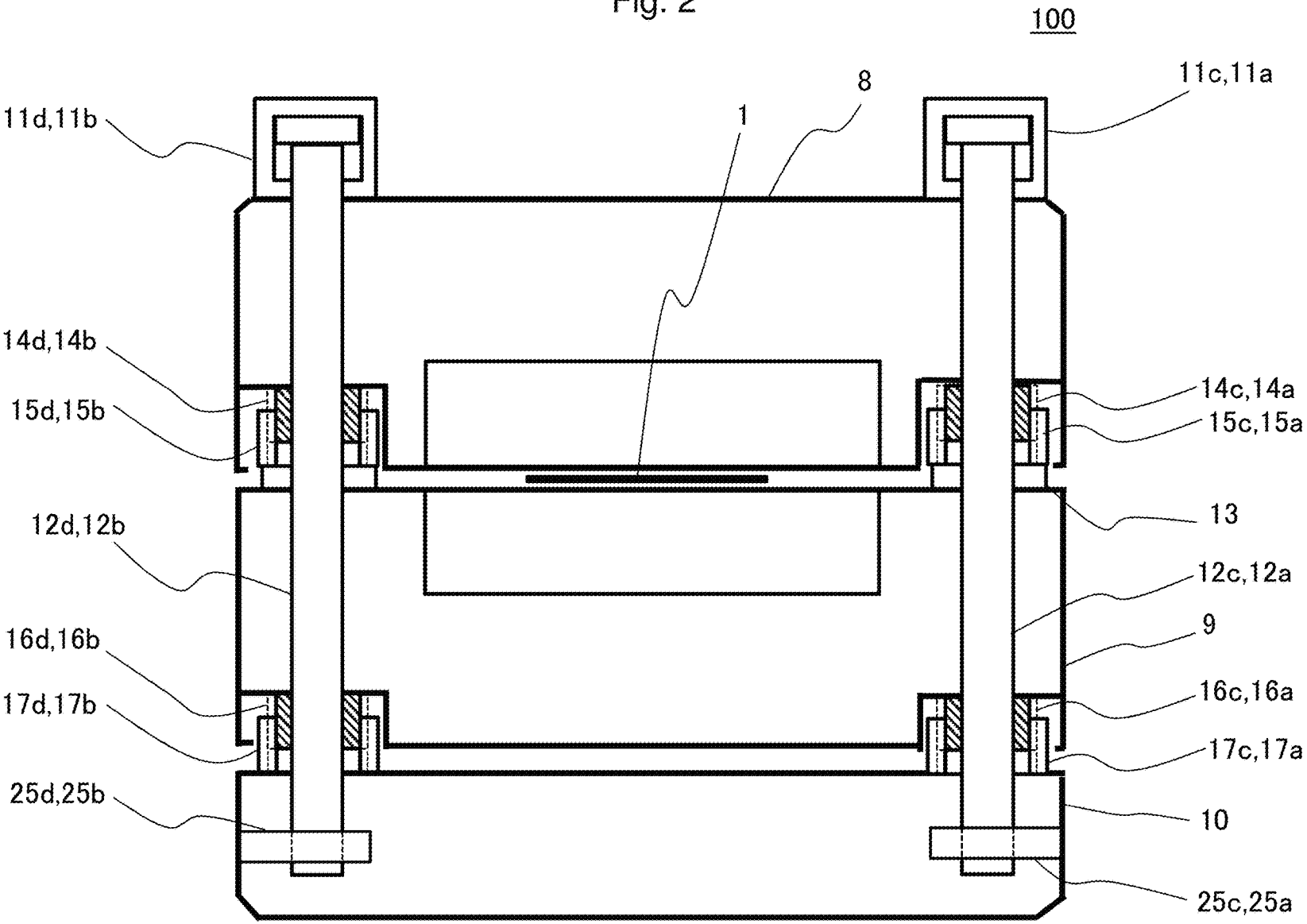
FIG. 2 is a sectional view taken along arrows A-A' of FIG. 1.
Figure 3:
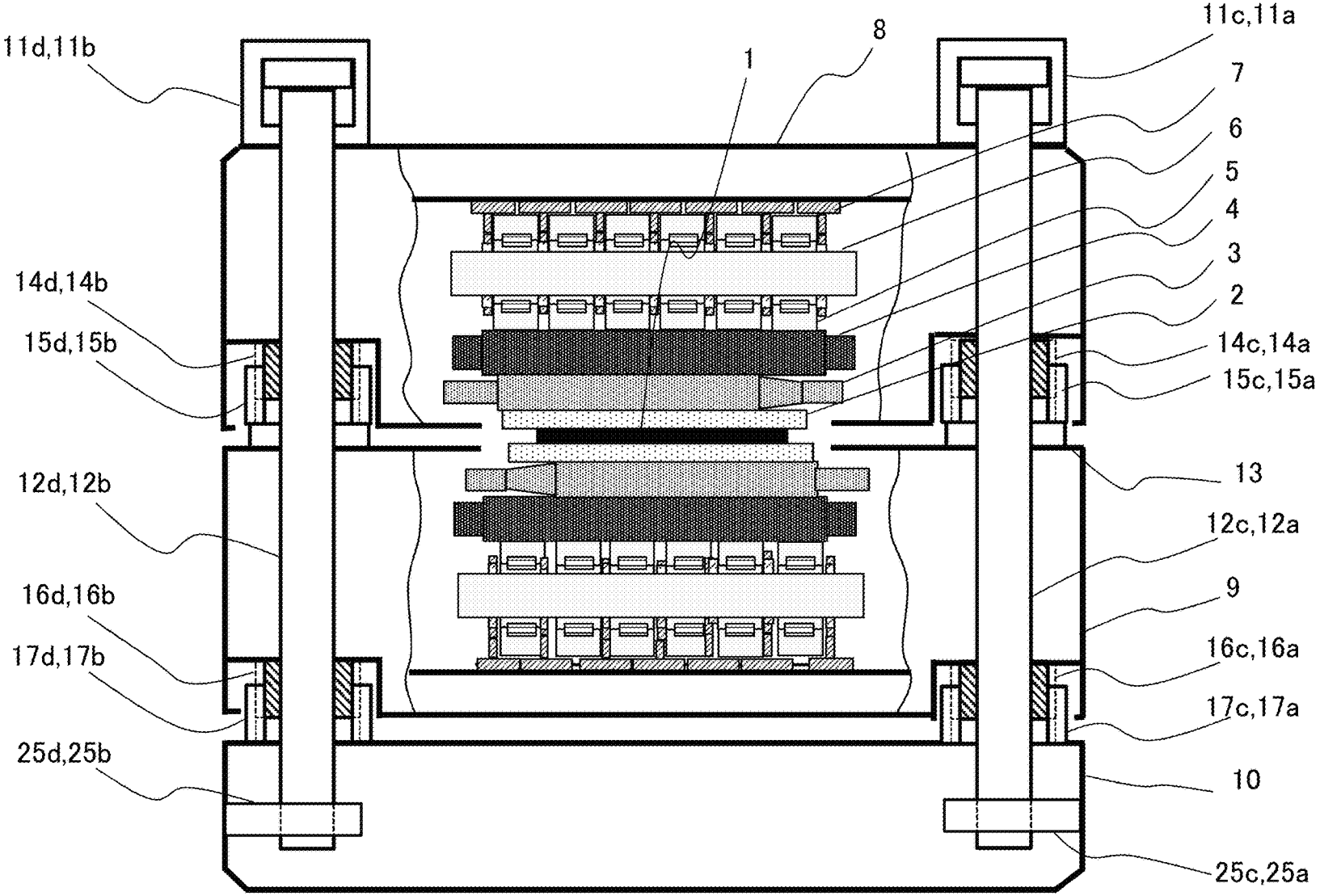
FIG. 3 is a sectional view taken along arrows B-B' of FIG. 1.
Figure 4:
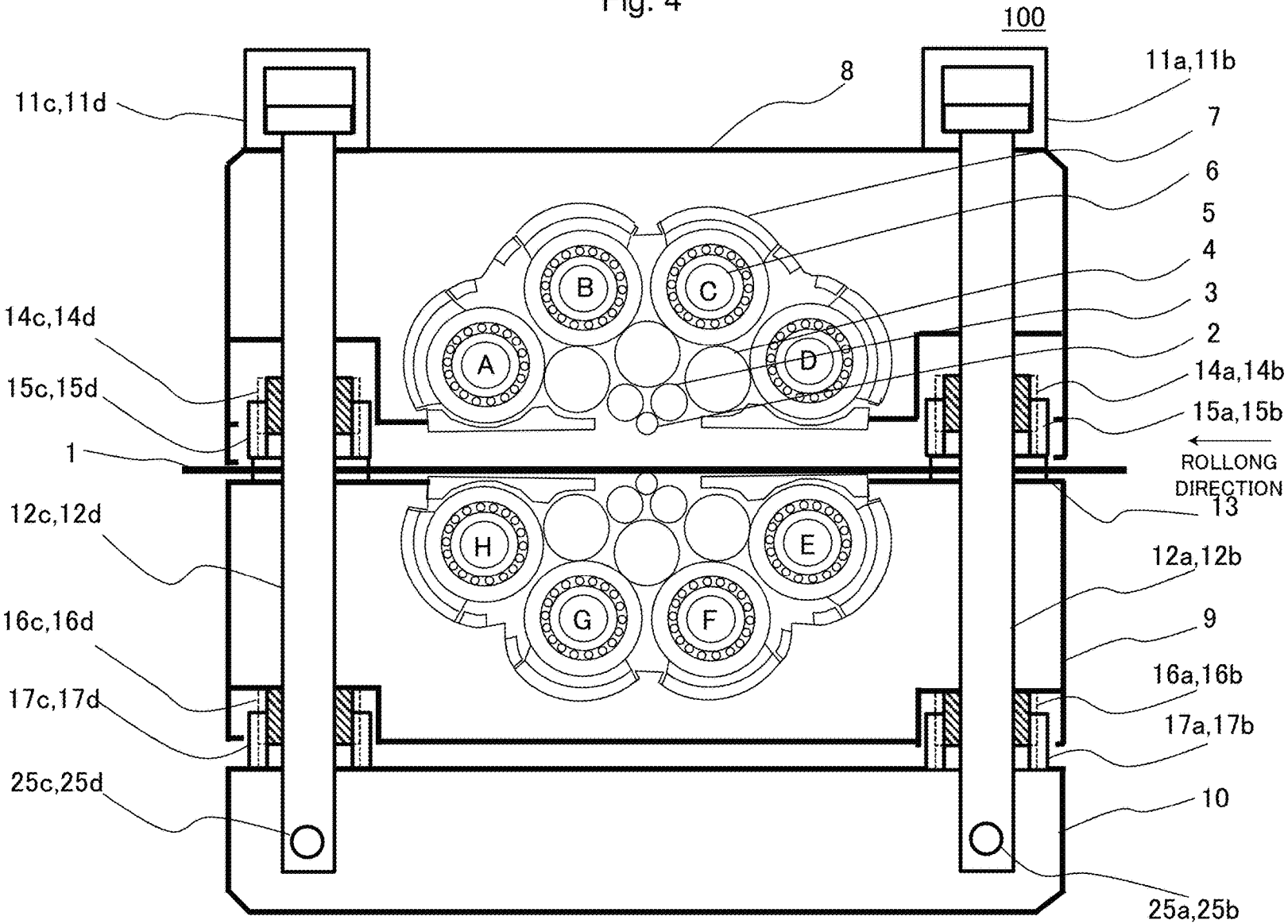
FIG. 4 is a diagram depicting a state in which an upper mill housing is raised in the 20-high rolling mill of FIG. 1.

First, a general configuration of the multistage rolling mill will be described with reference to FIGS. 1 to 4. FIG. 1 is a front view of a 20-high rolling mill according to the first embodiment, FIG. 2 is a sectional view taken along arrows A-A' of FIG. 1, FIG. 3 is a sectional view taken along arrows B-B' of FIG. 1, and FIG. 4 is a diagram depicting a state in which an upper mill housing is raised.

As depicted in FIGS. 1 to 4, the multistage rolling mill 100 of the present embodiment is a cluster-type 20-high rolling mill for rolling a strip 1, particularly, a rolling mill suitable for rolling a hard material such as a stainless steel strip, a magnetic steel strip, or a copper alloy.

In FIG. 1, the multistage rolling mill 100 includes, as rolls, a pair of upper and lower work rolls 2, two pairs of upper and lower first intermediate rolls 3, three pairs of upper and lower second intermediate rolls 4, four pairs of upper partition backing bearing shafts A, B, C, and D and lower partition backing bearing shafts E, F, G, and H each including a partition backing bearing 5, a shaft 6, and a saddle 7.

The pair of upper and lower work rolls 2 rolls the strip 1 which is a material to be rolled.

The pair of upper and lower work rolls 2 are each in contact with and supported by the two pairs of upper and lower first intermediate rolls 3. In addition, the two pairs of upper and lower first intermediate rolls 3 are each in contact with and supported by the three pairs of upper and lower second intermediate rolls 4.

In the present embodiment, the first intermediate rolls 3 and the second intermediate rolls 4 constitute an intermediate roll group that supports the work rolls 2.

Further, in the multistage rolling mill 100 of the present embodiment, the three pairs of upper and lower second intermediate rolls 4 are each in contact with and supported by the upper partition backing bearing shafts A, B, lower C, and D on the upper side in the vertical direction and the partition backing bearing shafts E, F, G, and H on the lower side in the vertical direction.

Each of the partition backing bearing shafts A, B, C, D, E, F, G, and H includes the partition backing bearing 5, the shaft 6, and the saddle 7. Of these, the upper partition backing bearing shafts A, B, C, and D located on upper side in the vertical direction are supported by the upper mill housing 8 at the saddle 7. In addition, the lower backing bearing shafts E, F, G, and H located on lower side in the vertical direction are supported by the saddle 7 at the lower mill housing 9.

On a lower side of the lower mill housing 9 in the vertical direction, a base mill housing 10 for fixing the multistage rolling mill 100 to a floor is provided.

At four corners on upper side of the upper mill housing 8 in the vertical direction, hydraulic cylinders 11*a*, 11*b*, 11*c*, and 11*d* that can raise and lower the upper mill housing 8 relative to the lower mill housing 9 are provided.

Four columns 12*a*, 12*b*, 12*c*, and 12*d* are connected respectively to the hydraulic cylinders 11*a*, 11*b*, 11*c*, and 11*d*. These four columns 12*a*, 12*b*, 12*c*, and 12*d* link, in an up-down direction, four corners of each of the upper mill housing 8, the lower mill housing 9, and the base mill housing 10.

The four columns 12*a*, 12*b*, 12*c*, and 12*d* have male screws 14*a*, 14*b*, 14*c*, and 14*d* and female screws 15*a*, 15*b*, 15*c*, and 15*d* disposed therein, respectively, between the upper mill housing 8 and the lower mill housing 9 so as to surround the peripheries thereof. The male screws 14*a*, 14*b*, 14*c*, and 14*d* and the female screws 15*a*, 15*b*, 15*c*, and 15*d* constitute an upper mill housing spacer.

In addition, a load cell 13 is disposed between the upper mill housing 8 and the lower mill housing 9.

Moreover, the four columns 12*a*, 12*b*, 12*c*, and 12*d* have male screws 16*a*, 16*b*, 16*c*, and 16*d* and female screws 17*a*, 17*b*, 17*c*, and 17*d* disposed therein, respectively, between the lower mill housing 9 and the base mill housing 10 so as to surround the peripheries thereof. The male screws 16*a*, 16*b*, 16*c*, and 16*d* and the female screws 17*a*, 17*b*, 17*c*, and 17*d* constitute a lower mill housing spacer.

In addition, in end parts of the four columns 12*a*, 12*b*, 12*c*, and 12*d* on a side opposite to a side connected to the hydraulic cylinders 11*a*, 11*b*, 11*c*, and 11*d*, pins 25*a*, 25*b*, 25*c*, and 25*d* for fixing the columns 12*a*, 12*b*, 12*c*, and 12*d* to the base mill housing 10 are inserted respectively.

With such a structure, in the multistage rolling mill 100 of the present embodiment, the upper mill housing 8, the upper mill housing spacer, the load cell 13, the lower mill housing 9, the lower mill housing spacer, and the base mill housing 10 are sandwiched by the four columns 12*a*, 12*b*, 12*c*, and 12*d*.

In other words, the hydraulic cylinders 11*a*, 11*b*, 11*c*, and 11*d* sandwich the upper mill housing 8, the lower mill housing 9, the base mill housing 10, the upper mill housing spacer, and the lower mill housing spacer through the four columns 12*a*, 12*b*, 12*c*, and 12*d*, thereby applying a prestress to the upper mill housing 8 and the lower mill housing 9, and securing a high mill rigidity.

in the upper mill housing spacer including the male screws 14*a*, 14*b*, 14*c*, and 14*d* and the female screws 15*a*, 15*b*, 15*c*, and 15*d*, rotational driving of the worm gear and the hydraulic motor (both omitted for convenience in illustration) or the like rotates the female screws 15*a*, 15*b*, 15*c*, and 15*d*, so that the male screws 14*a*, 14*b*, 14*c*, and 14*d* are raised or lowered. As a result, the position of the upper mill housing 8 in the height direction, namely, the position of the upper mill housing 8 in the vertical direction can be adjusted.

Note that a position sensor can detect the height of the male screws 14*a*, 14*b*, 14*c*, and 14*d* or the height of the male screws 14*a*, 14*b*, 14*c*, and 14*d* converted from the rotational speed of the female screws 15*a*, 15*b*, 15*c*, and 15*d*, or the height of the upper mill housing 8.

Similarly, in the lower mill housing spacer including the male screws 16*a*, 16*b*, 16*c*, and 16*d* and the female screws 17*a*, 17*b*, 17*c*, and 17*d*, rotational driving of the worm gear and the hydraulic motor (both omitted for convenience in illustration) or the like rotates the female screws 17*a*, 17*b*, 17*c*, and 17*d*, so that the male screws 16*a*, 16*b*, 16*c*, and 16*d* are raised or lowered. As a result, the position of the lower mill housing 9 in the height direction, namely, the position of the lower mill housing 9 in the vertical direction relative to the base mill housing 10 fixed to the floor can be adjusted.

Note that a position sensor can detect the height of the male screws 16*a*, 16*b*, 16*c*, and 16*d* or the height of the male screws 16*a*, 16*b*, 16*c*, and 16*d* converted from the rotational speed of the female screws 17*a*, 17*b*, 17*c*, and 17*d*, or the height of the lower mill housing 9.

In addition, for reducing loads on the female screws 17*a*, 17*b*, 17*c*, and 17*d* and the male screws 16*a*, 16*b*, 16*c*, and 16*d*, a lower mill housing lift-up hydraulic cylinder that holds the weight of the lower mill housing 9 can be provided.

The upper mill housing spacer and the lower mill housing spacer can also provide an effect that leveling control on the operation side and on the driving side can be performed by changing the position in the height direction on the operation side and the position in the height direction on the driving side (the male screw 16*a*, the female screw 17*a* and the male screw 16*b*, the female screw 17*b*, or the male screw 16*c*, the female screw 17*c* and the male screw 16*d*, the female screw 17*d*).

Note that the upper mill housing spacer and the lower mill housing spacer are not limited to a screw structure with a driving actuator depicted in FIGS. 1 to 4, and the worm jack can be adopted.

Figure 5:
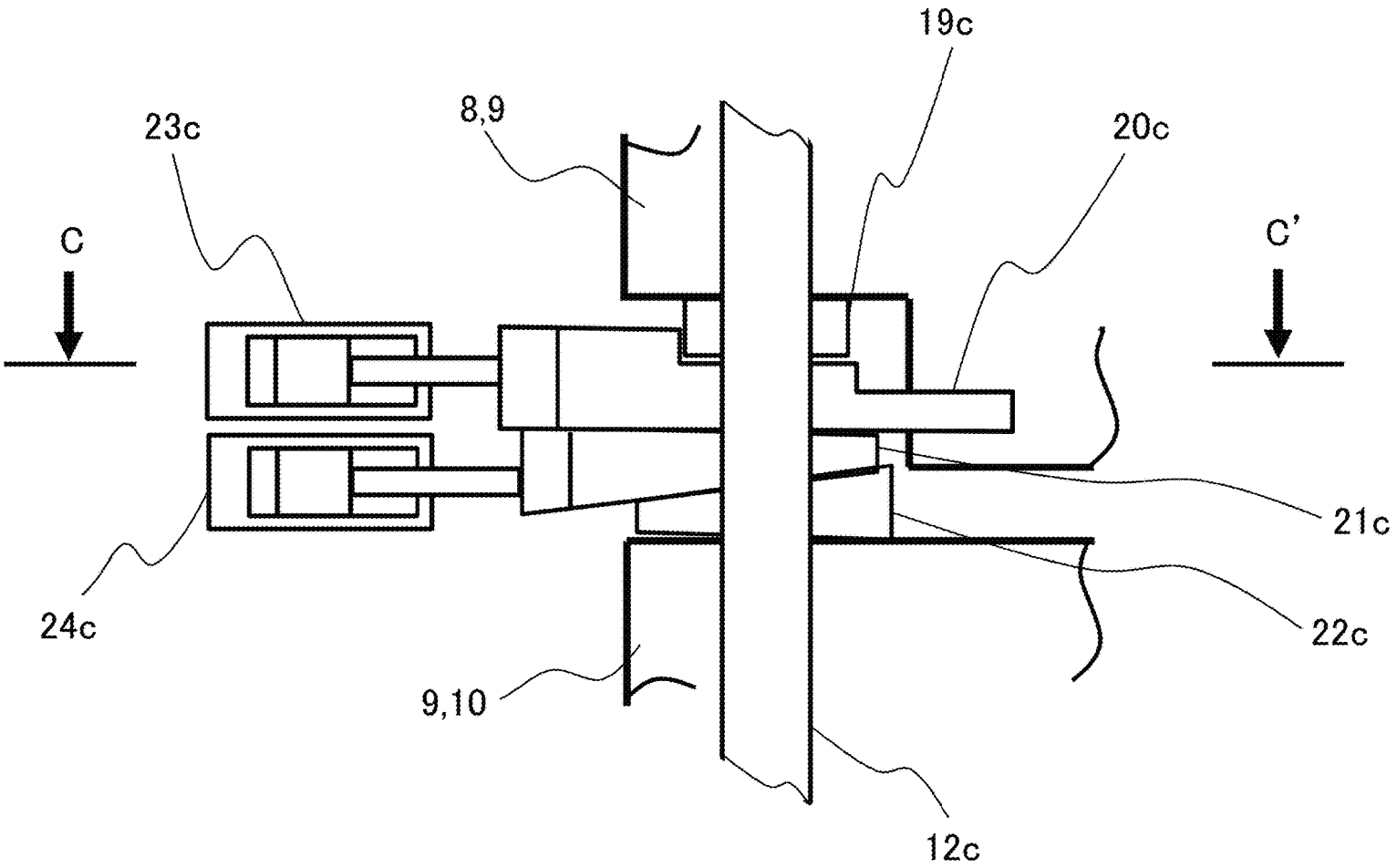
FIG. 5 is a front view depicting another form of a spacer section of the 20-high rolling mill of the first embodiment.
Figure 6:
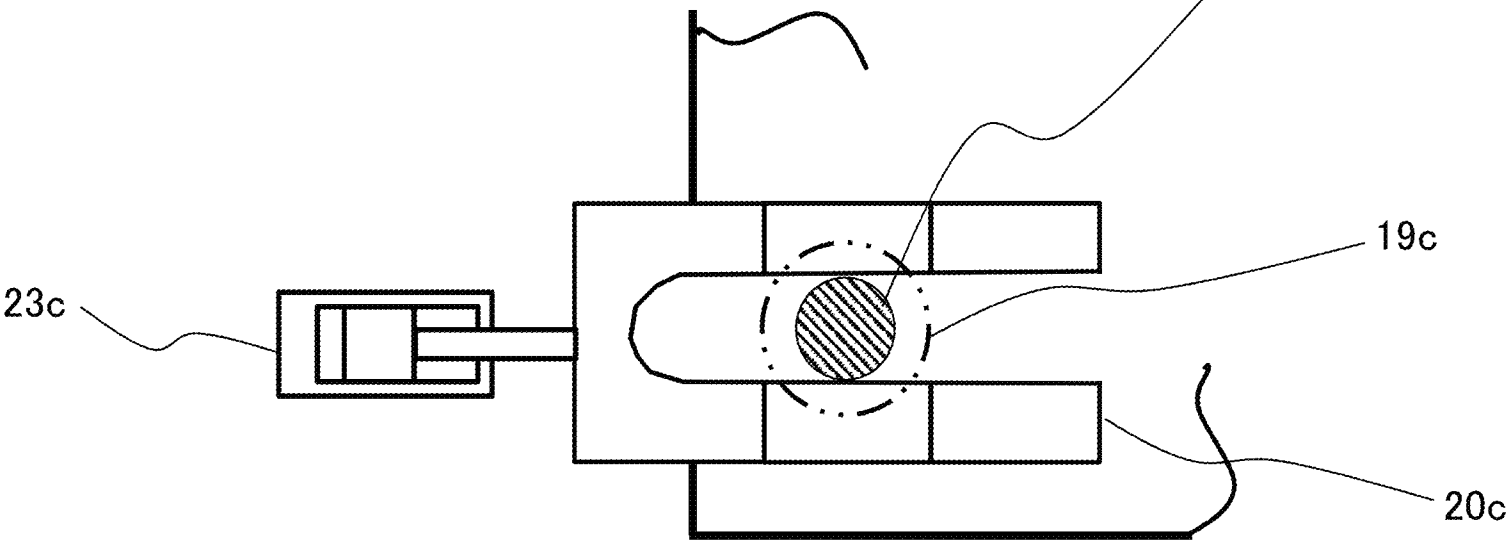
FIG. 6 is a sectional view taken along arrows C-C' of FIG. 5.

In addition, as depicted in FIGS. 5 and 6, a tapered wedge structure and a stepped rocker plate structure can be adopted. The form thereof will be described below. FIG. 5 is a front view depicting another form of a spacer section, and FIG. 6 is a sectional view taken along arrows C-C' of FIG. 5.

Note that, in FIGS. 5 and 6, the part of the column 12*c* is exemplified as a representative, and a similar structure can be adopted also at portions corresponding to the columns 12*a*, 12*b*, and 12*d*.

In addition, the upper mill housing spacer and the lower mill housing spacer provided at the four columns 12*a*, 12*b*, 12*c*, and 12*d* may all be the same in configuration, may all be different in configuration, or two or more of them may be the same in configuration, and the configurations thereof are not particularly limited.

As depicted in FIG. 5, the tapered wedge structure has an upper tapered wedge 21*c* and a lower tapered wedge 22 stacked in the vertical direction, while sandwiching the column 12*c* therebetween.

The upper tapered wedge 21*c* and the lower tapered wedge 22*c* are shifted in a horizontal direction by the hydraulic cylinder 24*c*, whereby the thickness is continuously varied. As a result, in the case of the upper mill housing spacer, the position of the upper mill housing 8 in the height direction can continuously be adjusted, and, in the case of the lower mill housing spacer, the position of the lower mill housing 9 in the height direction can continuously be adjusted. With such variation in height of the upper and lower mill housings, height adjustment can be continuously achieved in a wide range.

In addition, as depicted in FIGS. 5 and 6, the stepped rocker plate structure has a rocker plate 19*c* and a stepped rocker plate 20*c* stacked in the vertical direction, while sandwiching the column 12*c* therebetween.

The stepped rocker plate 20*c* is shifted in a horizontal direction by the hydraulic cylinder 23*c*, with its thickness varied stepwise, and, in the case of the upper mill housing spacer, the height of the upper mill housing 8 can be adjusted stepwise. In the case of the lower mill housing spacer, the position of the lower mill housing 9 in the height direction can be adjusted stepwise. With such variation in height of the upper and lower mill housings, height adjustment can be made stepwise in a wide range.

The stepped rocker plate 20*c* is not required to be rectangular parallelepiped in shape as depicted in FIGS. 5 and 6 and can adopt a structure having a disk shape and provided with a step to be rotated around the column 12*c*. In this structure, an advantage of being more compact is provided.

Also in the stepped rocker plate structure and the tapered wedge structure depicted in FIGS. 5 and 6, by changing the position in the height direction on the operation side and the position in the height direction the driving side, leveling control on the operation side and on the driving side can be performed.

Figure 7:
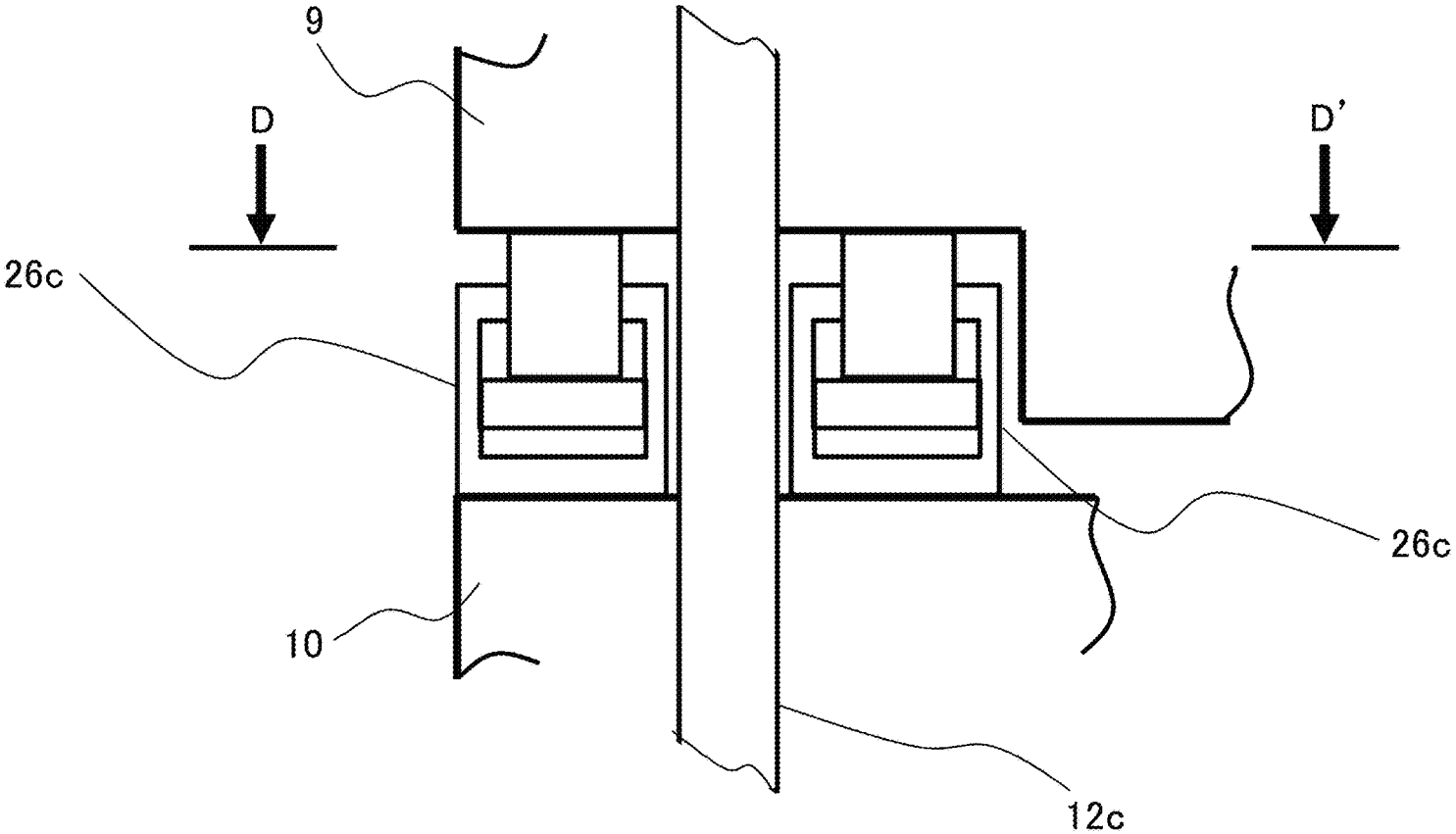
FIG. 7 is a front view depicting a further form of the spacer section of the 20-high rolling mill of the first embodiment.
Figure 8:
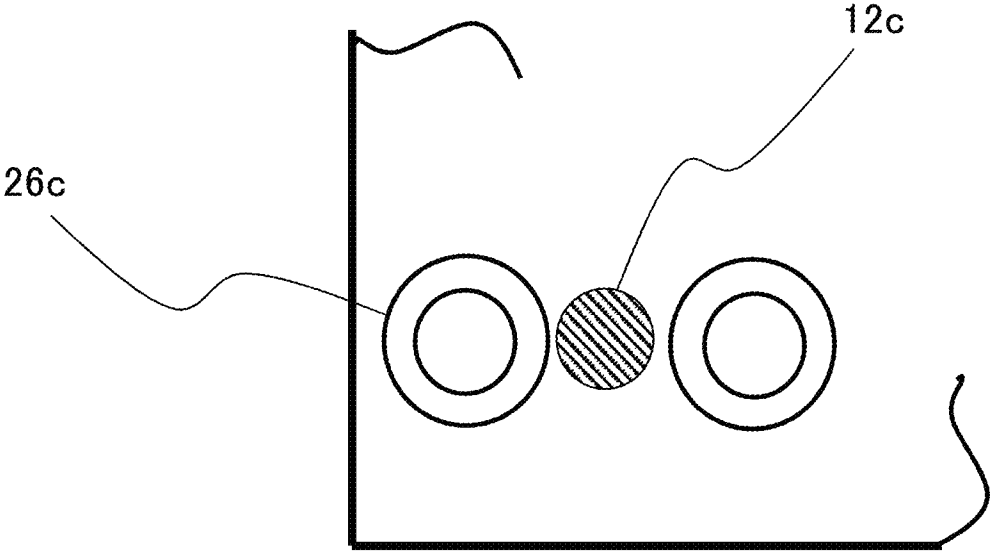
FIG. 8 is a sectional view taken along arrows D-D' of FIG. 7.

Further, the lower mill housing spacer is not limited to the forms depicted in FIGS. 1 to 6, and as depicted in FIGS. 7 and 8, the hydraulic cylinder can be adopted instead. The form thereof will be described below. FIG. 7 is a front view depicting a further form of the spacer section, and FIG. 8 is a sectional view taken along arrows D-D' of FIG. 7.

Note that a portion of the column 12*c* is exemplified as a representative also in FIGS. 7 and 8, a similar structure can be adopted also at portions corresponding to the columns 12*a*, 12*b*, and 12*d*.

As depicted in FIGS. 7 and 8, in a case where the lower mill housing spacer includes the hydraulic cylinder, a plurality of hydraulic cylinders are desirably provided. In addition, each hydraulic cylinder 26*c* is desirably controlled to a predetermined position by a servo valve or the like.

Further, even in these hydraulic cylinders 26*c*, by changing the height on the operation side and the driving side, leveling control on the operation side and the driving side can be performed.

In addition, at least any one portion of the lower mill housing spacers can adopt at least one of the screw structure with a driving actuator, the worm jack depicted in FIG. 1 or the like described above, the tapered wedge structure and the stepped rocker plate structure which are depicted in FIG. 5 or the like.

As a method of applying a rolling load in the multistage rolling mill 100 of the present embodiment, there is, for example, a method in which eccentric rings of the partition backing bearing shafts B, C are lowered by an eccentric amount, to apply a rolling load.

More specifically, there is provided a structure in which the shaft 6 is rotated by the hydraulic cylinder through a pinion gear connected to a rack and the shaft 6, and an eccentric ring of the saddle 7 simultaneously rotated by the shaft 6 and a key (both omitted for convenience in illustration) is rotated.

In addition, a rolling load can be measured as a differential load from application of a prestress load in the load cell 13.

Next, effects of the present embodiment will be described.

The cluster-type multistage rolling mill 100 of the first embodiment of the present invention described above includes the four columns 12*a*, 12*b*, 12*c*, and 12*d* that link, in an up-down direction, the four corners of each of the upper mill housing 8, the lower mill housing 9, and the base mill housing 10, a press-down section that is provided on the upper side of the four columns 12*a*, 12*b*, 12*c*, and 12*d* in the vertical direction and that can raise and lower the upper mill housing 8, and the lower mill housing spacer that is provided between the lower mill housing 9 and the base mill housing 10 and that adjusts the position of the lower mill housing 9 in the vertical direction.

With these configurations, the lower mill housing 9 has such a structure as to be linked by the four columns 12*a*, 12*b*, 12*c*, and 12*d* and slidingly be guided relative to the base mill housing 10 fixed to the floor, so that a rigid and large outer housing and outer frame necessary in the conventional structure as a sliding guide for raising and lowering the lower mill housing 9 are unnecessary, and a very compact structure as a rolling mill can be realized.

In addition, while being a compact structure, the height position of the lower mill housing 9 relative to the base mill housing 10 fixed to the floor is variable, so that a diameter of each roll, particularly, the use range of the work rolls 2 can be enlarged, and a pass line can be kept constant even when the diameter of the roll is varied.

For example, in the case of changing the work rolls 2 from small-diameter work rolls to large-diameter work rolls, by reversely rotating the female screws 17*a*, 17*b*, 17*c*, and 17*d* as the lower mill housing spacer, the male screws 16*a*, 16*b*, 16*c*, and 16*d* are lowered. As a result, the height of the lower mill housing 9 is lowered relative to the base mill housing 10 fixed to the floor, so that a space below the pass line is opened, and the small-diameter work rolls can be easily changed by the large-diameter work rolls.

Further, by changing the position on the operation side and the position on the driving side of the lower mill housing, an effect that leveling control can be made is also obtained.

Such a multistage rolling mill 100 can roll with a high strip thickness accuracy and the like when rolling a hard material such as a stainless steel strip, a magnetic steel strip, or a copper alloy strip, and therefore, a highly rigid and compact multistage rolling mill of a cluster roll disposition using small-diameter work rolls suitable for obtaining a strip of high product quality is realized.

In addition, since there is further provided the upper mill housing spacer that is provided between the upper mill housing 8 and the lower mill housing 9 and that adjusts the position of the upper mill housing 8 in the vertical direction, the height position of the upper mill housing 8 is variable. For example, by rotating the female screws 15*a*, 15*b*, 15*c*, and 15*d* as the upper mill housing spacer, the male screws 14*a*, 14*b*, 14*c*, and 14*d* are raised or lowered. As a result, the height of the upper mill housing 8 is raised, so that a space above the pass line is opened, and the upper work rolls can be changed from small-diameter work rolls to large-diameter work rolls on the upper side. Besides, by adjusting the positions of the upper mill housing spacer and the lower mill housing spacer in the height direction, there is obtained an effect that the pass line can be more easily kept constant.

Further, the press-down section sandwiches the upper mill housing 8, the lower mill housing 9, the base mill housing 10, the upper mill housing spacer, and the lower mill housing spacer through the four columns 12*a*, 12*b*, 12*c*, and 12*d*, thereby to apply a prestress, whereby a high mill rigidity can be secured.

In addition, the lower mill housing spacer and the upper mill housing spacer each include at least any one of the screw structure with a driving actuator, the worm jack, the tapered wedge structure, the stepped rocker plate structure, and the hydraulic cylinder, whereby the positions of the lower mill housing 9 and the upper mill housing 8 in the height direction can be adjusted with high accuracy even with a simple configuration.

Further, the lower mill housing spacer and the upper mill housing spacer are disposed so as to surround each column 12*a*, 12*b*, 12*c*, and 12*d* of the four columns 12*a*, 12*b*, 12*c*, and 12*d*. In a case where a distance between a region where a prestress load is applied and the lower mill housing spacer or the upper mill housing spacer is large, particularly there is a fear that the base mill housing 10 may be deformed due to a stress in the height direction, but, according to the configuration described above, the positions of the lower mill housing 9 and the upper mill housing 8 in the height direction can be adjusted in a peripheral region of the four columns 12*a*, 12*b*, 12*c*, and 12*d* on which the prestress load is applied. For this reason, the base mill housing 10 or the like can be prevented from being deformed in such a direction in which the base mill housing 10 is deflected.

In addition, since the press-down sections are the hydraulic cylinders 11*a*, 11*b*, 11*c*, and 11*d*, the upper mill housing 8 can be raised to a great extent as depicted in FIG. 4. As a result, the gap between the work rolls 2 is enlarged, so that change of the work rolls 2 and passing of the strip 1 becomes easier. Besides, treatment of broken pieces upon breakage of the strip becomes easier, so that an effect that operability is more improved is obtained.

Note that, while the 20-high cluster-type multistage rolling mill has been provided in the present embodiment, the structure of the present embodiment can be applied also to a 12-high cluster-type multistage rolling mill in which the number of rolls is smaller, such as that of a third embodiment to be described later.

Second Embodiment

Figure 9:
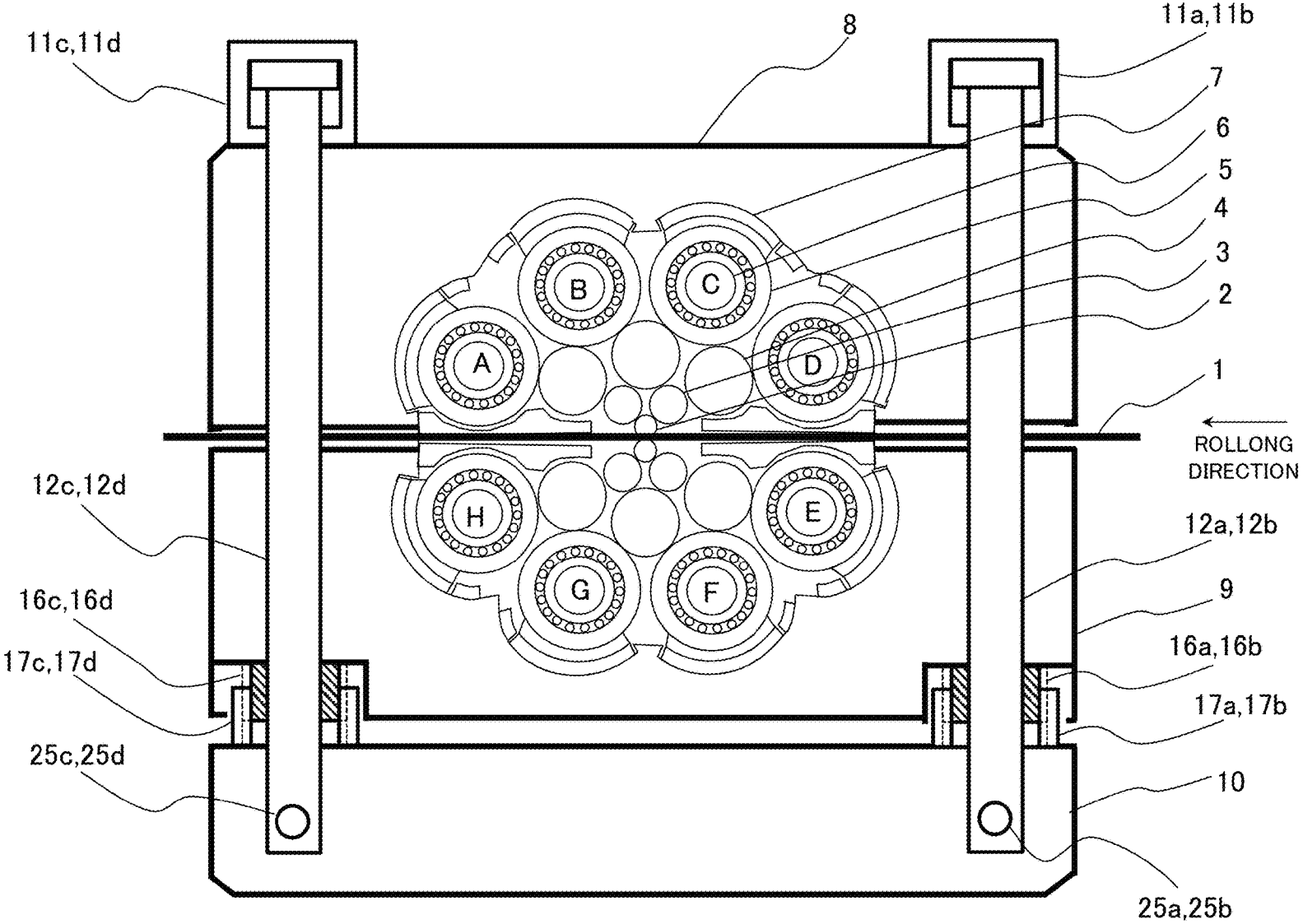
FIG. 9 is a front view of a 20-high rolling mill according to a second embodiment of the present invention.

A multistage rolling mill of a second embodiment of the present invention will be described with reference to FIG. 9. FIG. 9 is a front view of a 20-high rolling mill according to the second embodiment. The same configurations as those of the first embodiment are denoted by the same reference characters, and descriptions thereof are basically omitted. The same applies also to the following embodiments.

The multistage rolling mill 100A of the present embodiment depicted in FIG. 9 is a 20-high rolling mill similar to the multistage rolling mill 100 depicted in the first embodiment.

The multistage rolling mill 100A of the present embodiment has a configuration in which the upper mill housing spacer including the male screws 14*a*, 14*b*, 14*c*, and 14*d* and the female screws 15*a*, 15*b*, 15*c*, and 15*d* and the load cell 13 are omitted from the multistage rolling mill 100 of the first embodiment.

Since the upper mill housing spacer is omitted in the multistage rolling mill 100A, the hydraulic cylinders 11*a*, 11*b*, 11*c*, and 11*d* are used not for applying a prestress on the upper mill housing 8 and the lower mill housing 9 through the four columns 12*a*, 12*b*, 12*c*, and 12*d*, but for applying a rolling load.

In addition, the lower mill housing spacer including the male screws 16*a*, 16*b*, 16*c*, and 16*d* and the female screws 17*a*, 17*b*, 17*c*, and 17*d* is configured such that rotation of the female screws 17*a*, 17*b*, 17*c*, and 17*d* by rotational driving of the worm gear and the hydraulic motor or the like raises or lowers the male screws 16*a*, 16*b*, 16*c*, and 16*d*. As a result, it is possible to adjust the position of the lower mill housing 9 in the height direction relative to the base mill housing 10 fixed to the floor.

The other configurations and operations are substantially similar to those of the multistage rolling mill 100 of the first embodiment described above, and details thereof are omitted.

Also in the multistage rolling mill 100A of the second embodiment of the present embodiment, effects substantially similar to those of the multistage rolling mill 100 of the first embodiment described above can be obtained.

In addition, the multistage rolling mill 100A of the present embodiment cannot apply a prestress to the upper mill housing 8 and the lower mill housing 9 by the hydraulic cylinders 11*a*, 11*b*, 11*c*, and 11*d*, and therefore, it is more difficult than the first embodiment to enhance mill rigidity; however, since the number of constituent elements is smaller than that of the multistage rolling mill 100 of the first embodiment, there is an advantage of being more inexpensive.

Note that an example of the 20-high cluster-type multistage rolling mill has been provided also in the present embodiment, the structure of the present embodiment can be applied also to the 12-high cluster-type multistage rolling mill.

Third Embodiment

Figure 10:
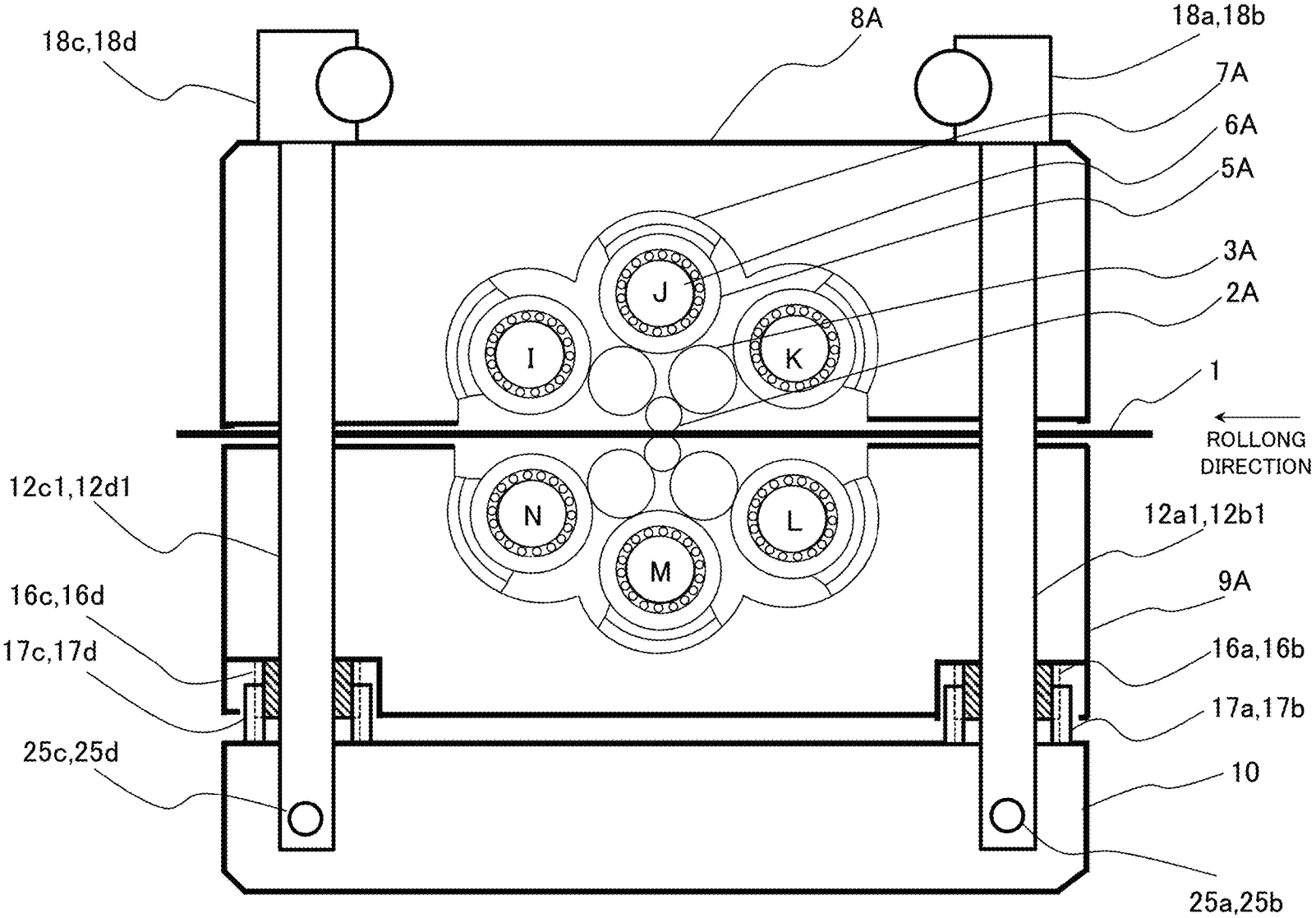
FIG. 10 is a front view of a 12-high rolling mill according to a third embodiment of the present invention.

A multistage rolling mill of a third embodiment of the present invention will be described with reference to FIG. 10. FIG. 10 is a front view of a 12-high rolling mill according to the third embodiment.

The multistage rolling mill 100B of the present embodiment depicted in FIG. 10 is a cluster-type 12-high rolling mill for rolling a strip 1.

As depicted in FIG. 10, the multistage rolling mill 100B includes a pair of upper and lower work rolls 2A, two pairs of upper and lower first intermediate rolls 3A, and three pairs of upper partition backing bearing shafts I, J, and K and lower partition backing bearing shafts L, M, and N each including a partition backing bearing 5A, a shaft 6A, and a saddle 7A.

The pair of upper and lower work rolls 2A are each in contact with and supported by the two pairs of upper and lower first intermediate rolls 3A. In the present embodiment, the first intermediate rolls 3A constitute an intermediate roll group that supports the work rolls 2A.

Further, in the multistage rolling mill 100B of the present embodiment, the two pairs of upper and lower first intermediate rolls 3A are each in contact with and supported by the upper partition backing bearing shafts I, J, and K and the lower partition backing bearing shafts L, M, and N.

Of these six partition backing bearing shafts, the upper partition backing bearing shafts I, J, and K on the upper side in the vertical direction are supported by the upper mill housing 8A through the their respective saddles 7A. Similarly, the lower partition backing bearing shafts L, M, and N on the lower side in the vertical direction are supported by the lower mill housing 9A through their respective saddles 7A.

On the lower side of the lower mill housing 9A in the vertical direction, a base mill housing 10 fixed to the floor is disposed.

At four corners on the upper side of the upper mill housing 8A in the vertical direction, worm jacks 18*a*, 18*b*, 18*c*, and 18*d* that can raise and lower the upper mill housing 8A relative to the lower mill housing 9A are provided.

The worm jacks 18*a*, 18*b*, 18*c*, and 18*d* are connected respectively with four columns 12*a*1, 12*b*1, 12*c*1, and 12*d*1. These four columns 12*a*1, 12*b*1, 12*c*1, and 12*d*1 link, in an up-down direction, the four corners of each of the upper mill housing 8A, the lower mill housing 9A, and the base mill housing 10.

The four columns 12*a*1, 12*b*1, 12*c*1, and 12*d*1 have the male screws 16*a*, 16*b*, 16*c*, and 16*d* and the female screws 17*a*, 17*b*, 17*c*, and 17*d* disposed, respectively, between the lower mill housing 9A and the base mill housing 10 so as to surround the peripheries thereof. Also in the present embodiment, the male screws 16*a*, 16*b*, 16*c*, and 16*d* and the female screws 17*a*, 17*b*, 17*c*, and 17*d* constitute the lower mill housing spacer.

In the present embodiment, since the upper mill housing spacer provided in the multistage rolling mill 100 provided in the first embodiment is omitted, the worm jacks 18*a*, 18*b*, 18*c*, and 18*d* are used not for applying a prestress to the upper mill housing 8A and the lower mill housing 9A through the four columns 12*a*1, 12*b*1, 12*c*1, and 12*d*1, but for adjusting the height of the upper mill housing 8A.

For example, in the case of changing the work rolls from small-diameter work rolls to large-diameter work rolls, the upper mill housing 8A is raised in height thereof by the worm jacks 18*a*, 18*b*, 18*c*, and 18*d*, so that a space above the pass line is opened, and the upper work roll can be changed from the small-diameter work roll to the large-diameter work roll on the upper side.

In addition, in the lower mill housing 9A, the male screws 16*a*, 16*b*, 16*c*, and 16*d* are lowered by rotating the female screws 17*a*, 17*b*, 17*c*, and 17*d*, resulting in that the height of the lower mill housing 9A is lowered relative to the base mill housing 10 fixed to the floor. Therefore, a space below the pass line is opened, and the lower work roll can be changed from the small-diameter work roll to the large-diameter work roll on the lower side. Besides, it also becomes possible to keep the pass line constant.

As a method for applying a rolling load in the multistage rolling mill 100B of the present embodiment, there is a method in which, for example, a tapered wedge is inserted by the hydraulic cylinder (both omitted for convenience' sake of illustration), and the saddle 7A is lifted up, thereby to raise the lower partition backing bearing shaft M by the tapered wedge insertion amount.

The other configurations and operations are substantially similar to those of the multistage rolling mill 100 of the first embodiment and the multistage rolling mill 100A of the second embodiment described above, and details thereof are omitted.

Also in the multistage rolling mill 100B of the third embodiment of the present invention, effects substantially similar to those of the multistage rolling mill 100A of the second embodiment described above can be obtained.

In addition, in the present embodiment, since a prestress load cannot be applied to the upper mill housing 8A and the lower mill housing 9A by the worm jacks 18*a*, 18*n*, 18*c*, and 18*d*, it is difficult to enhance the mill rigidity; however, since the number of constituent elements is smaller than that of the multistage rolling mill 100 of the first embodiment, there is an advantage of being more inexpensive.

Note that, while an example of the 12-high cluster-type multistage rolling mill has been provided in the present embodiment, the structure of the present embodiment can be applied to the 20-high cluster-type multistage rolling mill of the first embodiment and the second embodiment described above.

Others

Note that the present invention is not limited to the above-described embodiments and includes various modifications. The embodiments mentioned above are described in detail to describe the present invention in an easily understandable manner and are not necessarily limited to the one that includes all the configurations described above.

In addition, a part of the configuration of an embodiment can also be changed with the configuration of other embodiments, and the configuration of other embodiments can also be added to the configuration of an embodiment. In addition, other configurations can be added to, deleted from, or changed with the part of the configuration of each embodiment.

DESCRIPTION OF REFERENCE CHARACTERS

1: Strip (metal strip)
2, 2A: Work roll
3, 3A: First intermediate roll (intermediate roll group)
4: Second intermediate roll (intermediate roll group)
5, 5A: Partition backing bearing
6, 6A: Shaft
7, 7A: Saddle
8, 8A: Upper mill housing
9, 9A: Lower mill housing
10: Base mill housing
11*a*, 11*b*, 11*c*, 11*d*: Hydraulic cylinder (press-down section)
12*a*, 12*a*1, 12*b*, 12*b*1, 12*c*, 12*c*1, 12*d*, 12*d*1: Column
13: Load cell
14*a*, 14*b*, 14*c*, 14*d*: Male screw (upper mill housing spacer)
15*a*, 15*b*, 15*c*, 15*d*: Female screw (upper mill housing spacer)
16*a*, 16*b*, 16*c*, 16*d*: Male screw (lower mill housing spacer)
17*a*, 17*b*, 17*c*, 17*d*: Female screw (lower mill housing spacer)
18*a*, 18*b*, 18*c*, 18*d*: Worm jack (press-down section)
19*c*: Rocker plate (upper mill housing spacer, lower mill housing spacer)
20*c*: Stepped rocker plate (upper mill housing spacer, lower mill housing spacer)
21*c*: Upper tapered wedge (upper mill housing spacer, lower mill housing spacer)
22*c*: Lower tapered wedge (upper mill housing spacer, lower mill housing spacer)
23*c*, 24*c*: Hydraulic cylinder (upper mill housing spacer, lower mill housing spacer)
25*a*, 25*b*, 25*c*, 25*d*: Pin
26*c*: Hydraulic cylinder (lower mill housing spacer)
100, 100A, 100B: Multistage rolling mill
A, B, C, D, I, J, K: Upper partition backing bearing shaft
E, F, G, H, L, M, N: Lower partition backing bearing shaft

The invention claimed is:

1. A cluster multistage rolling mill comprising:
a pair of upper and lower work rolls that roll a metal strip;
an intermediate roll group that supports the work rolls;
a plurality of partition backing bearing shafts each including a partition backing bearing, a shaft, and a saddle that support the intermediate roll group;
an upper mill housing that supports an upper side partition backing bearing shafts in a vertical direction, of the partition backing bearing shafts;
a lower mill housing that supports a lower side partition backing bearing shafts in the vertical direction, of the partition backing bearing shafts;
a base mill housing disposed on a lower side of the lower mill housing in the vertical direction;
four columns that link, in an up-down direction, four corners of each of the upper mill housing, the lower mill housing, and the base mill housing;
a press-down section that is provided on an upper side of the four columns in the vertical direction and that is capable of raising and lowering the upper mill housing; and
a lower mill housing spacer that is provided between the lower mill housing and the base mill housing and that adjusts a position of the lower mill housing in the vertical direction.

2. The cluster multistage rolling mill according to claim 1, further comprising:
an upper mill housing spacer that is provided between the upper mill housing and the lower mill housing and that adjusts a position of the upper mill housing in the vertical direction.

3. The cluster multistage rolling mill according to claim 2, wherein the press-down section sandwiches the upper mill housing, the lower mill housing, the base mill housing, the upper mill housing spacer, and the lower mill housing spacer through the four columns to apply a pre-stress.

4. The cluster multistage rolling mill according to claim 1, wherein the lower mill housing spacer includes at least any one of a screw structure with a driving actuator, a worm jack, a tapered wedge structure, a stepped rocker plate structure, and a hydraulic cylinder.

5. The cluster multistage rolling mill according to claim 2, wherein the upper mill housing spacer includes at least any one of a screw structure with a driving actuator, a worm jack, a tapered wedge structure, and a stepped rocker plate structure.

6. The cluster multistage rolling mill according to claim 3, wherein the lower mill housing spacer is disposed so as to surround each of the four columns.

7. The cluster multistage rolling mill according to claim 3, wherein the upper mill housing spacer is disposed so as to surround each of the four columns.

8. The cluster multistage rolling mill according to claim 1, wherein the intermediate roll group includes two pairs of upper and lower first intermediate rolls that support the work rolls, and three pairs of upper and lower second intermediate rolls that support the first intermediate rolls, and the partition backing bearing shafts support the second intermediate rolls by four pairs of upper and lower partition backing bearing shafts.

9. The cluster multistage rolling mill according to claim 1, wherein the intermediate roll group includes two pairs of upper and lower first intermediate rolls that support the work rolls, and the partition backing bearing shafts support the first intermediate rolls by three pairs of upper and lower partition backing bearing shafts.

10. The cluster multistage rolling mill according to claim 1, wherein the press-down section is a hydraulic cylinder or a worm jack.

* * * * *